US006938446B2

(12) United States Patent
Fukunaga et al.

(10) Patent No.: US 6,938,446 B2
(45) Date of Patent: Sep. 6, 2005

(54) VEHICLE DOOR LOCK APPARATUS

(75) Inventors: Katsutoshi Fukunaga, Chiryu (JP); Makoto Suzumura, Kariya (JP); Ryujiro Akizuki, Kariya (JP); Norio Konomoto, Nagoya (JP); Akira Muramatsu, Chiryu (JP); Shigeru Hayakawa, Chiryu (JP); Yasuhiko Sono, Hekinan (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/983,904

(22) Filed: Oct. 26, 2001

(65) Prior Publication Data

US 2002/0056298 A1 May 16, 2002

(30) Foreign Application Priority Data

Oct. 26, 2000 (JP) ..... 2000-326809

(51) Int. Cl.[7] ..... E05B 65/12
(52) U.S. Cl. ..... 70/237; 70/461; 70/379 R
(58) Field of Search ..... 70/237, 238, 461, 70/379 R, 379 A, 380, 374, 466, 279.1, 278.2

(56) References Cited

U.S. PATENT DOCUMENTS

| | | | | | |
|---|---|---|---|---|---|
| 1,674,514 | A | * | 6/1928 | Jacobi | 70/379 R |
| 2,476,333 | A | * | 7/1949 | Tierney et al. | 292/123 |
| 2,477,063 | A | * | 7/1949 | Jacobi | 74/579 R |
| 2,530,469 | A | * | 11/1950 | Jacobi | 70/379 R |
| 2,650,492 | A | * | 9/1953 | Jacobi | 70/490 |
| 2,687,637 | A | * | 8/1954 | Jacobi | 70/224 |
| 2,750,788 | A | * | 6/1956 | Jacobi | 70/379 R |
| 4,905,532 | A | | 3/1990 | Fukumoto et al. | |
| 4,947,664 | A | * | 8/1990 | Lindmayer et al. | 70/422 |
| 5,050,410 | A | * | 9/1991 | Claar et al. | 70/237 |
| 5,224,364 | A | * | 7/1993 | Claar et al. | 70/237 |
| 5,615,564 | A | * | 4/1997 | Inoue | 70/279.1 |
| 6,405,571 | B2 | * | 6/2002 | Tyas | 70/237 |
| 6,415,636 | B1 | * | 7/2002 | Fukumoto et al. | 70/208 |
| 2002/0184931 | A1 | * | 12/2002 | Wittwer | 70/237 |

FOREIGN PATENT DOCUMENTS

| | | |
|---|---|---|
| DE | 43 19 295 C | 7/1984 |
| DE | 38 32 952 C | 9/1994 |
| DE | 195 27 837 C | 9/2000 |
| FR | 2 759 110 A1 | 8/1998 |
| GB | 2 296 936 A | 7/1996 |
| JP | 2000-160900 A | 6/2000 |

* cited by examiner

*Primary Examiner*—John B. Walsh
(74) *Attorney, Agent, or Firm*—Burns, Doane, Swecker & Mathis, L.L.P.

(57) ABSTRACT

A vehicle door lock apparatus includes a lever mechanism directly connected with a key cylinder provided at the outside door handle for locking and unlocking the vehicle door in response to rotation operation of the key cylinder. The lever mechanism is provided with a key rotor directly connected with the key cylinder, and a key lever directly connected with the key rotor. An input shaft of the lever mechanism formed by the key rotor is inclinable relative to an output shaft of the lever mechanism formed by the key lever, and this inclination is absorbed through the connection between the key rotor and the key lever.

18 Claims, 6 Drawing Sheets

VEHICLE DOOR LOCK APPARATUS

This application is based on and claims priority under 35 U.S.C. §119 with respect to Japanese Application 2000-326809 filed on Oct. 26, 2000, the entire content of which is incorporated herein by reference.

FIELD OF THE INVENTION

This invention generally relates to a door lock. More particularly, the present invention pertains to a vehicle door lock apparatus.

BACKGROUND OF THE INVENTION

A known vehicle door lock apparatus is disclosed in a Japanese patent application publication published on Jun. 13, 2000 as Toku-Kai 2000-160900. The disclosed vehicle door lock apparatus includes a link mechanism connected with an outside handle and an inside handle for allowing vehicle door opening, a lever mechanism directly connected with a key cylinder provided at the outside handle for locking and unlocking the vehicle door by conducting a changeover of engagement and disengagement of the link mechanism in response to rotation operation of the key cylinder, and a drive mechanism for locking and unlocking the vehicle door by conducting the changeover of engagement and disengagement of the link mechanism by an electric drive in response to a controlling condition. Through operation of the outside handle or the inside handle, the vehicle door is allowed to be open through the link mechanism. Through the rotation operation of the key cylinder, engagement and disengagement of the link mechanism is changed over through the lever mechanism and the door is locked and unlocked. Further, with the electric drive, engagement and disengagement of the link mechanism is changed over through the drive mechanism and the door is locked and unlocked.

In the vehicle door lock apparatus disclosed in the publication mentioned above, because the key cylinder is provided at the outside handle, a rotation shaft direction of the key cylinder is dependent on the form of the door design and is not extended in a single direction. Thus, in order to connect this key cylinder with the lever mechanism, a bracket angle has been adjusted for fixing a door lock actuator accommodating the lever mechanism to the door lock body for dealing with this problem. That is, an individual bracket is prepared in response to the particular door design, and the rotation shaft direction of the lever mechanism is adjusted in response to the angle restricted by the bracket for achieving a direct connection between the key cylinder and the lever mechanism. Accordingly, the brackets are not versatile and the number of required parts is increased, as is the manufacturing cost, according to the number of different bracket types.

To try to decrease the number of different bracket types, the key cylinder is required to be directly connected with the door lock actuator (lever mechanism) provided in a specified position. With this approach, flexibility associated with the mounting angle (rotation shaft direction) is significantly restricted.

SUMMARY OF THE INVENTION

According to one aspect of the present invention, a vehicle door lock apparatus includes a lever mechanism directly connected with a key cylinder provided at an outside door handle for locking and unlocking the vehicle door in response to a rotation operation of the key cylinder. The lever mechanism has an input shaft directly connected with the key cylinder and inclinable relative to an output shaft of the lever mechanism.

The input shaft of the lever mechanism includes a key rotor directly connected with the key cylinder and the output shaft includes a key lever directly connected with the key rotor. The inclination of the input shaft relative to the output shaft of the lever mechanism is absorbed through the connection between the key rotor and the key lever.

The key rotor is formed with a key rotor-side engaging device, and the key lever is formed with a key lever-side engaging device into which the key rotor-side engaging device is loosely inserted. The inclination of the input shaft relative to the output shaft of the lever mechanism is absorbed through play between the key rotor-side engaging device and the key lever-side engaging device.

The key rotor and the key lever are each provided with a locating device for locating a rotation fulcrum of the key rotor, and the rotation shaft or axis of the key cylinder is inclinable relative to the rotation shaft or axis of the key rotor.

The input shaft of the lever mechanism directly connected with the key cylinder is inclinable relative to the output shaft of the lever mechanism. The inclination of the rotation shaft or axis of the key cylinder can be absorbed between the input shaft and the output shaft of the lever mechanism, this increasing the flexibility of the mounting angle. The inclination of the input shaft relative to the output shaft of the lever mechanism can be absorbed through the connection between the key rotor and the key lever. The inclination of the input shaft relative to the output shaft of the lever mechanism can thus be absorbed in an easy manner by virtue of the play between the key rotor-side engaging device of the key rotor and the key lever-side engaging device of the key lever.

The locating devices are formed at the key rotor and the key lever for locating the rotation fulcrum of the key rotor. Thus, the connection between the key rotor and the key lever, which is configured so that the inclination of the input shaft relative to the output shaft of the lever mechanism can be absorbed, is prevented from falling off.

The rotation shaft of the key cylinder is capable of being inclined relative to that of the key rotor. Thus, the inclination of the rotation shaft or axis of the key cylinder can be further absorbed and the flexibility of the mounting angle of the key cylinder can be further increased.

In accordance with another aspect of the invention, a vehicle door lock apparatus includes a key lever, a key rotor and a key cylinder having a key rod. The end of the key rod is provided with a key cylinder-side engaging portion. The key rotor has an engaging portion, with the key cylinder-side engaging portion of the key rod and the engaging portion of the key rotor being fitted together to transmit rotation of the key rod to the key rotor while permitting a rotation axis of the key rod and a rotation axis of the key rotor to be inclined relative to one another. The key rotor also has a key rotor-side engaging portion. The key lever has a key lever-side engaging portion, with the key rotor-side engaging portion of the key rotor and the key lever-side engaging portion of the key lever being fitted together to transmit rotation of the key rotor to the key lever while permitting the rotation axis of the key rotor and a rotation axis of the key lever to be inclined relative to one another.

According to another aspect of the invention, a vehicle door lock apparatus includes a door lock actuator integrally accommodating a link mechanism connected with an outside door handle for opening the vehicle door, a lever mechanism for locking and unlocking the vehicle door by conducting a changeover of engagement and disengagement of the link mechanism in response to rotation operation of a key cylinder, and a drive mechanism for locking and unlocking the vehicle door by conducting the changeover of engagement and disengagement of the link mechanism by electric drive. The lever mechanism has an input shaft directly connected with the key cylinder and inclinable relative to an output shaft of the lever mechanism for actuating the locking and unlocking of the vehicle door.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

FIG. 5(*b*) is a front view of the rod of the key cylinder.

FIG. 6(*b*) is a side view of the key rotor.

FIG. 6(*c*) is a bottom view of the key rotor.

FIG. 8(*b*) is a cross-sectional view of the key lever taken along the section line 8B—8B in FIG. 7.

DETAILED DESCRIPTION OF THE INVENTION

Figure 1:
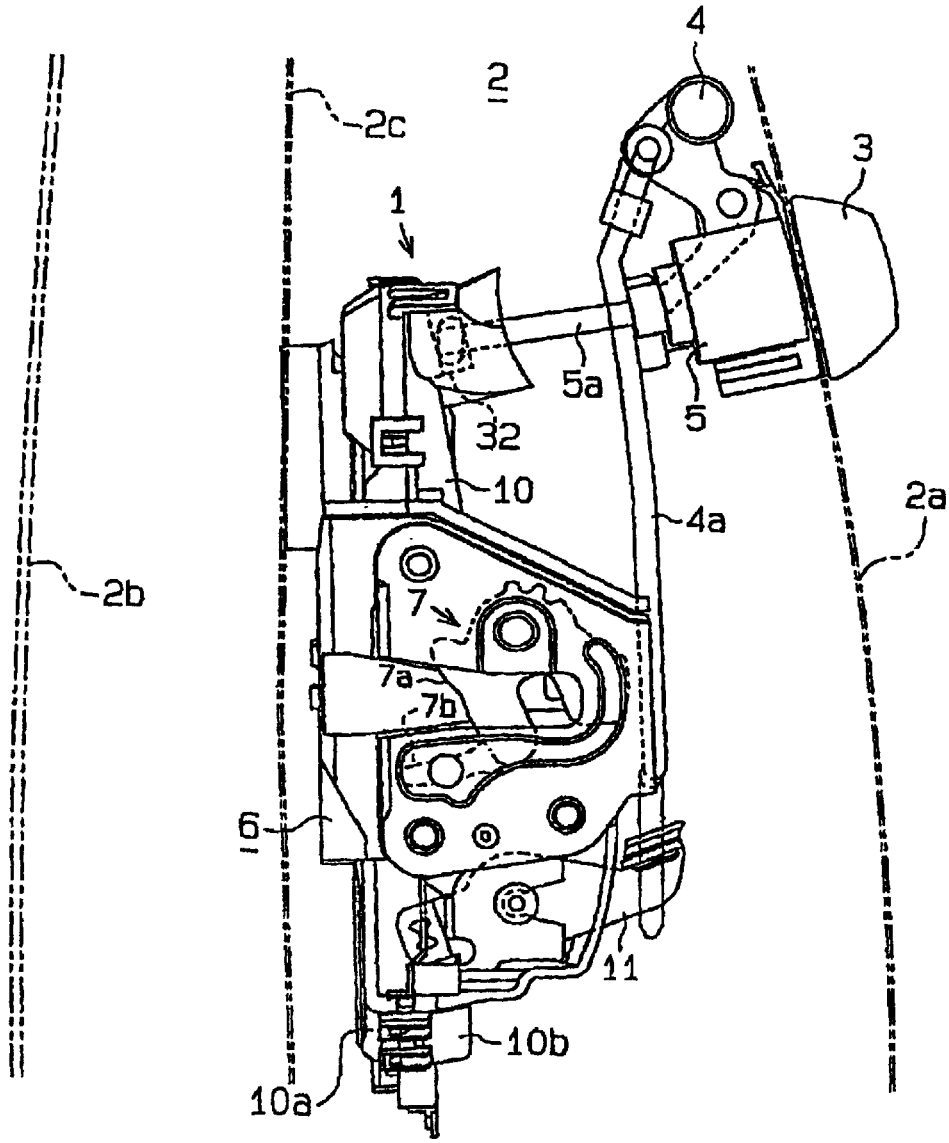
FIG. 1 is a side view of a vehicle door lock apparatus according to the present invention.

An embodiment of a vehicle door lock apparatus in accordance with the present invention is described below with reference to FIGS. 1–8. Referring initially to FIG. 1, which is a side view of the vehicle door lock apparatus 1 viewed from the side of a vehicle door 2, the vehicle door 2 includes a door outer panel 2*a* forming an exterior design or exterior portion, a door trim 2*b* forming an interior design or interior portion, and a door inner panel 2*c* disposed between the door outer panel 2*a* and the door trim 2*b*. The door outer panel 2*a* is provided with an outside door handle 3 disposed at an inclined position in accordance with the design or contour of the door outer panel 2*a* for opening and closing the vehicle door 2.

The outside door handle 3 is connected to a handle-side link mechanism 4. By pulling out the outside door handle 3, a rod 4*a* provided at or connected to the handle-side link mechanism 4 is depressed. The outside door handle 3 also accommodates a key cylinder 5 connected to an inwardly extending rod 5*a*. Upon inserting a key into the key cylinder 5 and then rotating the key, the key rod 5*a* of the key cylinder 5 is integrally rotated. The rotation shaft or rotation axis of the rod 5*a* or key cylinder 5 is dependent on the disposition of the outside handle 3 (i.e., the design of the vehicle door 2) and extends in a direction in which the rotation shaft or rotation axis of the rod 5*a* maintains a predetermined angle towards a horizontal direction.

Figure 4:
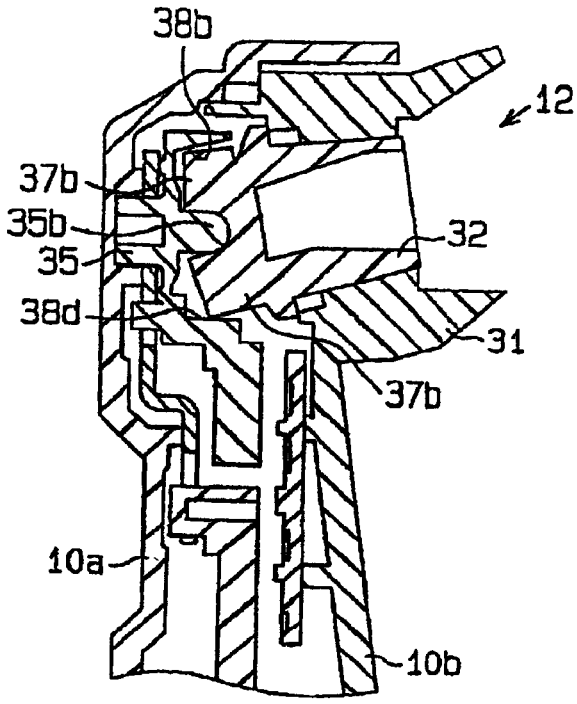
FIG. 4 is a cross-sectional view of the door lock apparatus of the present invention.

A door lock actuator 6 is disposed between the door outer panel 2*a* and the door inner panel 2*c* at a position opposing the door inner panel 2*c*. A connecting lever 11 of the door lock actuator 6 is connected to the rod 4*a* for transmitting a depression force or movement of the rod 4*a* to the door lock actuator 6. A resinous case 10 forming the outer shape of the door lock actuator 6 includes a first housing 10*a* positioned to face the door inner panel 2*c* and a second housing 10*b* for engaging the first housing 10*a*. A space is defined between the first housing 10*a* and the second housing 10*b*. Accommodated in this space is a lever mechanism 12 corresponding to the rod 5*a* of the key cylinder 5 as shown in FIG. 4. The lever mechanism 12 is directly connected with the rod 5*a* of the key cylinder 5 in a manner described in more detail below. Thus, the rotation of the key through the rod 5*a* is directly transmitted to the lever mechanism 12.

Figure 2:
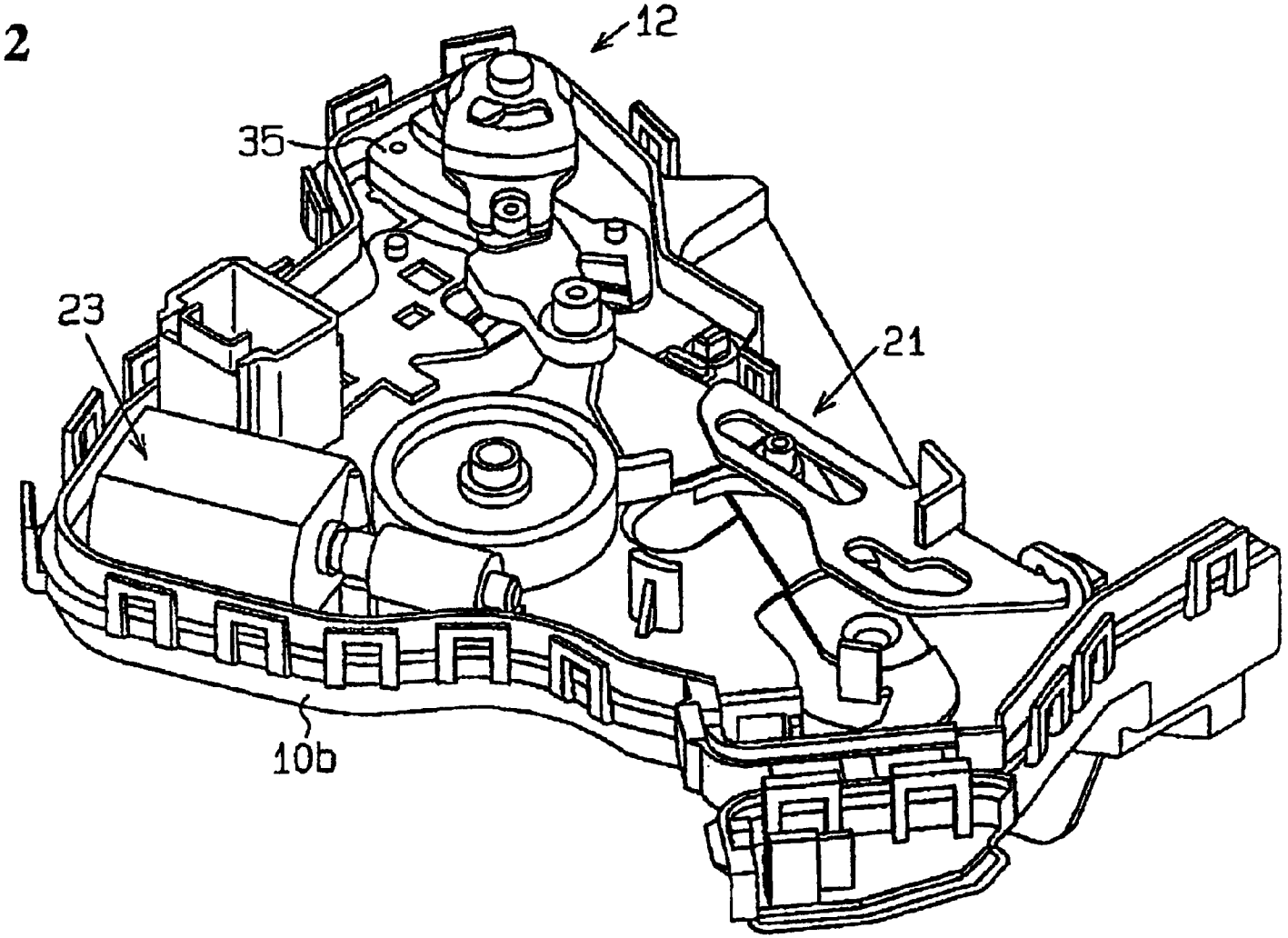
FIG. 2 is a perspective view of the inside of a case portion of the vehicle door lock apparatus according to the present invention.

As shown in FIG. 2, an actuator-side link mechanism 21 is accommodated inside the door lock actuator 6 or the case 10. The depression of the rod 4*a* is transmitted to the actuator-side link mechanism 21 through the connecting lever 11. The actuator-side link mechanism 21 is connected with a pawl 7*b* of a latch mechanism 7 which is illustrated in FIG. 1. The latch mechanism 7 includes a latch 7*a* and a pawl 7*b*. With the vehicle door 2 closed as shown in FIG. 1, the latch 7*a* and the pawl 7*b* are engaged with each other. When the depression of the rod 4*a* by pulling out the outside handle 3 is transmitted to the pawl 7*b* of the latch mechanism 7 through the connecting lever 11 and the actuator-side link mechanism 21, the engagement between the latch 7*a* and the pawl 7*b* is released and the vehicle door 2 is allowed to be opened.

As described above, the lever mechanism 12 is also accommodated inside the door lock actuator 6. When the rotation of the key is transmitted to the lever mechanism 12 through the rod 5*a* of the key cylinder 5, the lever mechanism 12 conducts a changeover of engagement and disengagement of the actuator-side link mechanism 21 to lock and unlock the vehicle door 2.

Further, as shown in FIG. 2, a motor drive mechanism 23 is accommodated inside the door lock actuator 6 or the case. Through operation of the motor by virtue of electricity being supplied in response to a controlling condition, the rotational drive of the motor causes the motor drive mechanism 23 to conduct a changeover of engagement and disengagement of the actuator-side link mechanism 21 to lock and unlock the vehicle door 2.

Figure 3:
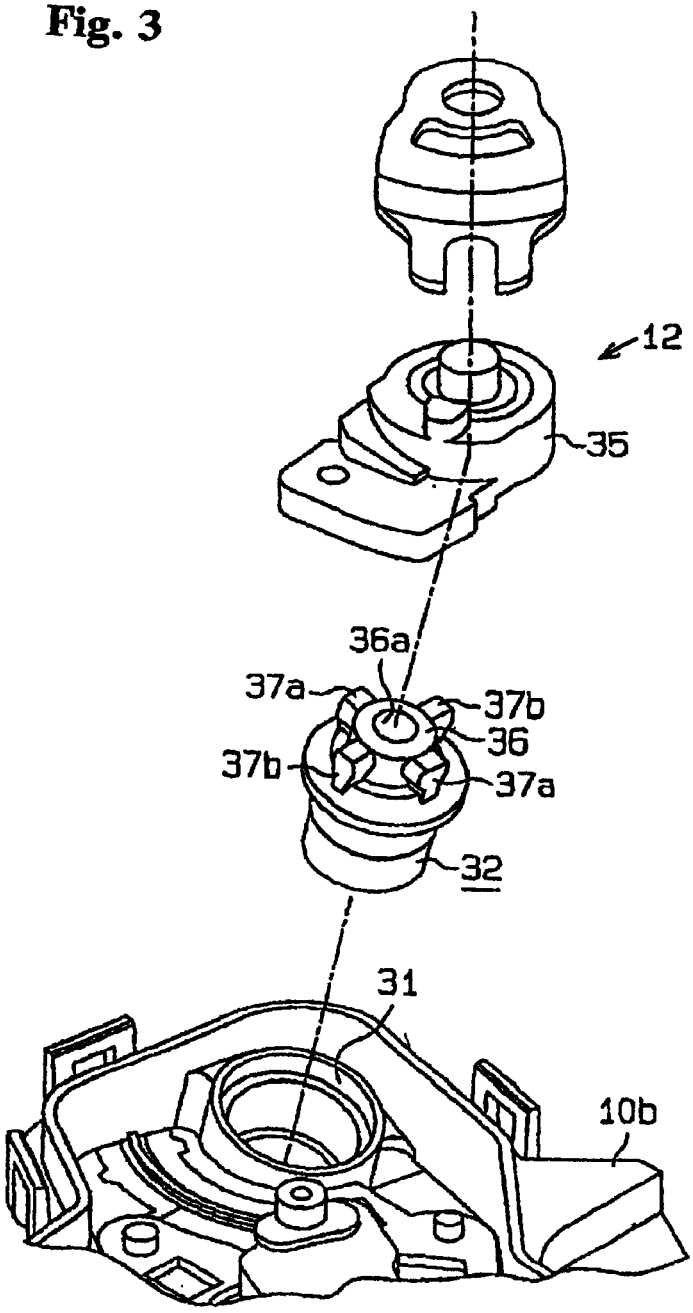
FIG. 3 is an exploded perspective view of the door lock apparatus of the present invention.

FIGS. 3–8 illustrate the connecting mechanism associate with the key cylinder 5 (rod 5*a*) and the lever mechanism 12. As shown in FIGS. 3 and 4, the second housing 10*b* of the case 10 accommodates or includes a key rotor receiving portion 31 having an approximately cylindrical shape corresponding to the rod 5*a* of the key cylinder 5. A key rotor 32 is rotatably connected in the key rotor receiving portion 31. The key rotor 32 has a slightly smaller outer diameter than the inner diameter of the key rotor receiving portion 31 and possesses an approximately operculate cylindrical shape. The rotation shaft or rotation axis of the key rotor 32 is dependent on the rotation shaft of the key cylinder 5 or rod 5*a*, and extends in a direction in which the rotation shaft or rotation axis of the key rotor 32 maintains a predetermined angle towards such a horizontal direction. The key rotor 32 represents an input shaft of the lever mechanism 12 and is directly connected with the rod 5*a* of the key cylinder 5.

Figure 5A:
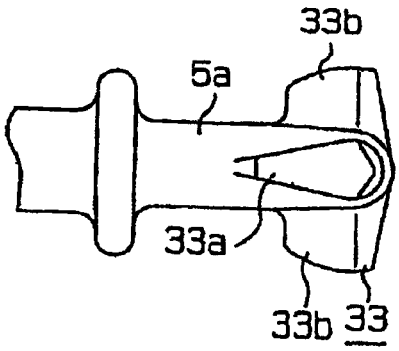
FIG. 5(*a*) is a side view of a rod of the key cylinder.
Figure 5B:
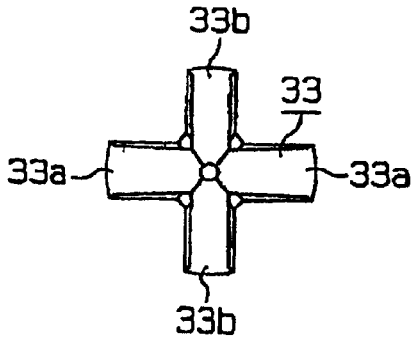

As shown in FIG. 5, the tip portion of the rod 5*a* of the key cylinder 5 is provided with a key cylinder-side engaging portion 33 having an approximately sectional cross shape (a cross-shaped configuration) formed by engaging projections 33*a*, 33*b* positioned approximately perpendicular to each other and extending in the radial direction. Each engaging projection 33*a*, 33*b* has a top surface that is inclined gently outward in the radial direction towards the side of the rod 5*a*. The width dimension of the engaging projections 33*a*, 33*b* is also formed to be inclined.

Figure 6A:
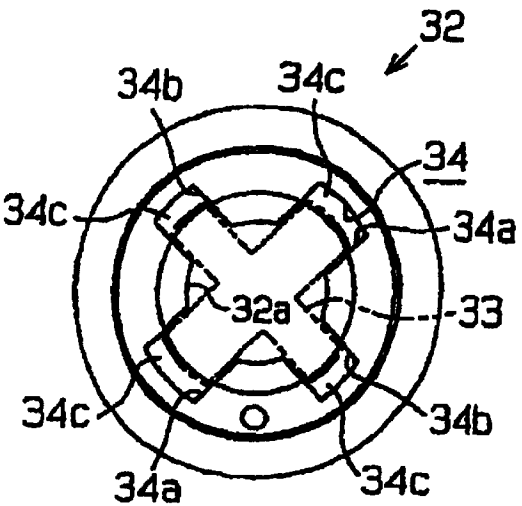
FIG. 6(*a*) is a plan view of the key rotor.
Figure 6B:
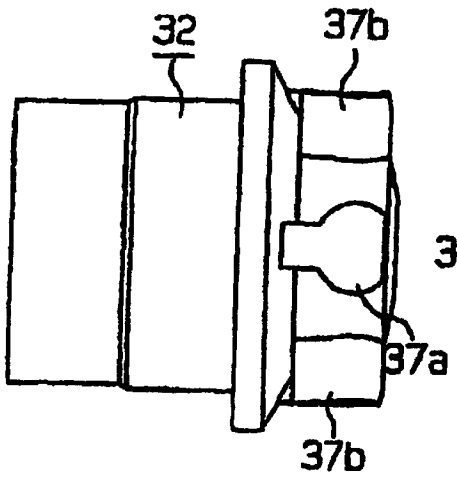
Figure 6C:
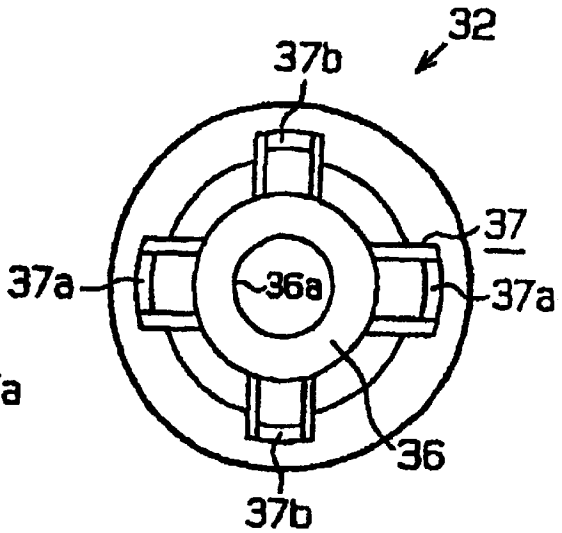

As shown in FIG. 6(*a*), the key rotor 32 is formed with a concave or recessed portion 32*a* having an approximately sectional rounded shape along a shaft line of the key rotor 32. Corresponding to the key cylinder-side engaging portion 33 (engaging projections 33*a*, 33*b*) of the rod 5*a*, an engaging portion 34 is provided at the concave or recessed portion 32*a* of the key rotor 32. The engaging portion 34 has an approximately sectional cross shape (a cross shaped configuration) formed by engaging concave portions 34*a*, 34*b* positioned approximately perpendicular each other and extending in the radial direction. Each engaging concave portion 34*a*, 34*b* is formed with a tapered surface 34*c* gently spreading toward the opening side thereof. Accordingly, by the gentle inclination in the radially outward direction of each engaging projection 33*a*, 33*b* of the key cylinder-side engaging portion 33 of the rod 5*a*, the inclination in the width direction of each engaging projection 33*a*, 33*b*, and the tapered surface 34*c* of each engaging concave portion 34*a*, 34*b*, the key cylinder-side engaging portion 33 is loosely inserted into the engaging portion 34 of the key rotor 32 as shown in FIG. 6(*a*). With the rod 5*a* of the key cylinder 5 being directly connected to the key rotor 32 under this condition, the rotation shaft or rotation axis of the key cylinder 5 can be inclined relative to that of the key rotor 32. That is, the inclination of the rotation shaft or axis of the key cylinder 5 relative to that of the key rotor 32 is absorbed by virtue of the play that is possible between the key cylinder-side engaging portion 33 and the engaging portion 34 of the key rotor 32.

As shown in FIG. 4, the key rotor 32 is connected with a key lever 35 rotatably supported by the first housing 10*a* and representing an output shaft of the lever mechanism 12. As shown in FIGS. 3, 6(*b*) and 6(*c*), one end portion (a lid portion) of the key rotor 32 is formed with a boss portion 36 having an approximately cylindrical shape, and a locating hole 36*a* functioning as a locating device with respect to an inner surface of the boss portion 36. The outer surface of the boss portion 36 is provided with a key rotor-side engaging portion 37 as an engaging device for the key rotor side. The key rotor-side engaging portion 37 has an approximately sectional cross shape (a cross-shaped configuration) defined by engaging projections 37*a*, 37*b* that are approximately perpendicular to each other and extend in the radial direction. As shown in FIG. 6(*b*), each engaging projection 37*a*, 37*b* extends outward in the radial direction in an approximately columnar shape. Each engaging projection 37*a*, 37*b* is formed with a gently curved surface along the shaft line thereof.

Figure 7:
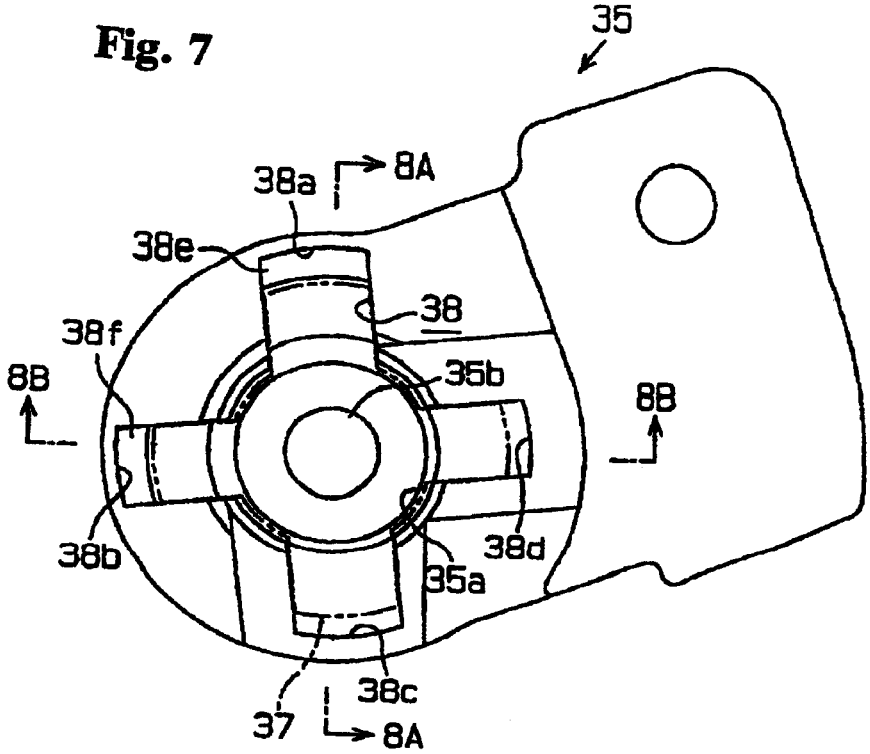
FIG. 7 is a plan view of the key lever.
Figure 8A:
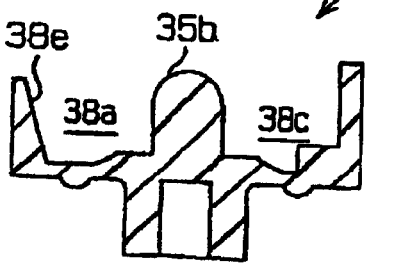
FIG. 8(*a*) is a cross-sectional view of the key lever taken along the section line 8A—8A in FIG. 7.
Figure 8B:
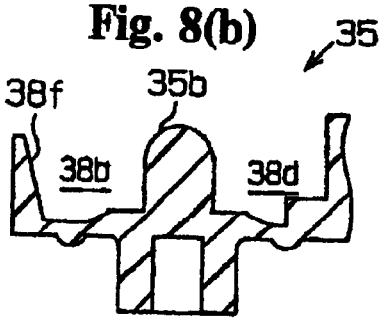

As shown in FIGS. 7, 8(*a*) and 8(*b*), the key lever 35 has an approximately plate shaped configuration and is provided with a concave or recessed portion 35*a*. The recessed portion 35*a* has an approximately sectional annular shape along the shaft line of the key lever 35. Corresponding to the key rotor-side engaging portion 37 (engaging projections 37*a*, 37*b*) of the boss portion 36 of the key rotor 32, a key lever-side engaging portion 38 is provided at the recessed portion 35*a* as an engaging device for the key lever side. The recessed portion 35*a* has an approximately sectional cross shape (a cross-shaped configuration) formed by engaging concave portions 38*a*, 38*b*, 38*c*, 38*d* which are approximately perpendicular to each other and extend in the radial direction. Tapered surfaces 38*e*, 38*f* are provided at the tip portions of the respective engaging concave portions 38*a*, 38*b*. These tapered surfaces 38*e*, 38*f* spread gently towards each opening side thereof.

As shown in FIG. 4, the rotation shaft or axis of the key rotor 32 accommodated in the key rotor receiving portion 31 and corresponding to the key cylinder 5 is inclined relative to the rotation shaft or axis of the key lever 35. The tapered surfaces 38*e*, 38*f* are provided in accordance with the inclined direction of the key rotor 32. Accordingly, by virtue of the gently curved surfaces of the engaging projections 37*a*, 37*b* along the shaft line thereof, and the tapered surfaces 38*e*, 38*f* of the engaging concave portions 38*a*, 38*b*, the key rotor-side engaging portion 37 of the key rotor 32 is loosely inserted into the key lever-side engaging portion 38 of the key lever 35 as shown in FIG. 7. With the key rotor 32 being directly connected with the key lever 35 under this condition, the rotation shaft or axis of the key rotor 32 can be inclined relative to that of the key lever 35. That is, the inclination of the rotation shaft or axis of the key rotor 32 relative to that of the key lever 35 is absorbed through play between the key rotor-side engaging portion 37 and the key lever-side engaging portion 38.

As shown in FIGS. 8(*a*) and 8(*b*), the wall surfaces of the recessed portion 35*a* facing or disposed opposite to each of the tapered surfaces 38*e*, 38*f* is formed to be higher than each of the tapered surfaces 38*e*, 38*f* of the key lever-side engaging portion 38 of the key lever 35. This is for certainly or reliably accommodating the key rotor 32 in response to inclination of the key rotor 32 relative to the key lever 35.

A projecting portion projecting from a center of the concave portion 35*a* along the shaft line or axial center line of the concave portion 35*a* forms a locating projection 35*b* which functions as a locating device. The locating projection 35*b* is inserted into the locating hole 36*a* of the key rotor 32 for locating a rotation fulcrum of the key rotor 32.

As described above, the inclination of the rod 5*a* of the key cylinder 5 extending with a predetermined angle towards a horizontal direction is absorbed or permitted, in order, through the play between the key cylinder-side engaging portion 33 and the engaging portion 34 of the key rotor 32, and the play between the key rotor-side engaging portion 37 of the key rotor 32 and the key lever-side engaging portion 38 of the key lever 35. The rotation of the key through the rod 5*a* is smoothly transmitted to the key lever 35, and thus the lever mechanism 21, through the key rotor 32. With the rotation of the key being transmitted to the lever mechanism 12, the lever mechanism 12 conducts the changeover of engagement and disengagement of the actuator-side link mechanism 21 to lock and unlock the vehicle door 2.

By virtue of the present invention, a variety of advantages are obtained. The input shaft of the lever mechanism 12 connected with the key cylinder 5 is inclinable relative to the output shaft of the lever mechanism 12. That is, the inclination of the input shaft relative to the output shaft of the lever mechanism 12 can be absorbed or permitted through the connection between the key rotor 32 directly connected with the key cylinder 5 and the key lever 35 directly connected with the key rotor 32. Thus, flexibility associated with the mounting angle of the key cylinder 5 can be increased.

The inclination of the rotation shaft or axis of the key rotor 32 relative to that of the key lever 35 can be absorbed in an easy manner through the play that is permitted between the key rotor-side engaging portion 37 of the key rotor 32 and the key lever-side engaging portion 38 of the key lever 35.

In addition, the locating hole 36*a* is formed at the key rotor 32 and the locating projection 35*b* is formed at the key lever 35 for locating the rotation fulcrum of the key rotor 32. Thus, the connection between the key rotor 32 and the key lever 35, whose rotation shafts or axes are inclinable relative to one another, is prevented from being disconnected.

Also, the rotation shaft or axis of the key cylinder 5 (rod 5*a*) is inclinable relative to that of the key rotor 32. Thus, the inclination of the rotation shaft or axis of the key cylinder 5 can be further absorbed and the flexibility of the mounting angle of the key cylinder 5 can be further increased.

Further, the inclination of the rotation shaft of the key cylinder 5 (rod 5*a*) relative to that of the key rotor 32 can be absorbed in an easy manner through the play between the engaging portion 34 of the key rotor 32 and the key cylinder-side engaging portion 33 of the rod 5*a*.

It is to be understood that the embodiment of the invention is not limited to the specific details described above as variations can be employed. For example, in the above embodiment of this invention, as the locating device, the locating hole 36*a* is provided at the key rotor 32 and the locating projection 35*b* is provided at the key lever 35. However, the locating projection can be provided at the key rotor 32 and the locating hole can be provided at the key lever 35.

The key cylinder-side engaging portion 33 of the rod 5*a* is loosely inserted into the recessed engaging portion 34 of the key rotor 32. However, the engaging relationship between the key cylinder-side engaging portion 33 and the engaging portion 34 can be reversed so that the key cylinder-side engaging portion 33 is provided with a recessed portion.

In the above described embodiment of this invention, the inclination of the rotation shaft or axis of the key cylinder 5 (rod 5*a*) relative to that of the key rotor 32 is absorbed through the play between the engaging portion 34 of the key rotor 32 and the key cylinder-side engaging portion 33 of the rod 5*a*. However, other connecting structures (universal coupling structure) can be adapted for absorbing this play.

Also, in the described embodiment of this invention, the key rotor-side engaging portion 37 of the key rotor 32 is loosely inserted into the key lever-side engaging portion 38 of the key lever 35. However, this engaging relationship between the key rotor-side engaging portion 37 and the key lever-side engaging portion 38 can be reversed (i.e., the key rotor-side engaging portion 37 can be recessed).

In addition, the inclination of the rotation shaft or axis of the key rotor 32 relative to that of the key lever 35 is absorbed through the play between the key rotor-side engaging portion 37 of the key rotor 32 and the key lever-side engaging portion 38 of the key lever 35. However, other connecting structures (universal coupling structure) can be adopted for absorbing such play.

The lever mechanism 12, the actuator-side link mechanism 21 and the motor drive mechanism 23 are described as being integrally accommodated in the door lock actuator 6. However, it is also possible, for example, for the door lock actuator 6 to accommodate only the lever mechanism 12 and the motor drive mechanism 23.

The principles, preferred embodiment and modes of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A vehicle door lock apparatus comprising:

a key cylinder that includes a rod, an end of the rod being provided with a key cylinder-side engaging portion;

a key rotor having an engaging portion, the key cylinder-side engaging portion of the rod and the engaging portion of the key rotor being fitted together to transmit rotation of the rod to the key rotor while permitting a rotation axis of the rod and a rotation axis of the key rotor to be inclined relative to one another;

the key rotor having a key rotor-side engaging portion; and a key lever having a key lever-side engaging portion, the key rotor-side engaging portion of the key rotor and the key lever-side engaging portion of the key lever being fitted together to transmit rotation of the key rotor to the key lever while permitting the rotation axis of the key rotor and a rotation axis of the key lever to be inclined relative to one another.

2. The vehicle door lock apparatus according to claim 1, including a locating hole provided in one of the key rotor and the key lever and a location projection provided on the other of the key rotor and the key lever, the locating projection being fitted into the locating hole to define a rotation fulcrum of the key rotor.

3. The vehicle door lock apparatus according to claim 1, wherein the engaging portion of the key rotor is provided on one side of the key rotor and the key rotor-side engaging portion is provided on an opposite side of the key rotor.

4. The vehicle door lock apparatus according to claim 1, wherein the key rotor-side engaging portion of the key rotor includes a plurality of engaging projections, the key lever-side engaging portion of the key lever including a plurality of engaging recessed portions, the engaging projections being fitted into the engaging recessed portions.

5. The vehicle door lock apparatus according to claim 4, wherein the engaging projections are arranged in a cross-shaped arrangement, and the engaging recessed portions are arranged in a cross-shaped arrangement.

6. The vehicle door lock apparatus according to claim 1, wherein the key cylinder-side engaging portion of the rod includes a plurality of engaging projections and the engaging portion of the key rotor includes a plurality of engaging recessed portions, the engaging projections being fitted into the engaging recessed portions.

7. The vehicle door lock apparatus according to claim 6, wherein the engaging projections are arranged in a cross-shaped arrangement, and the engaging recessed portions are arranged in a cross-shaped arrangement.

8. The vehicle door lock apparatus according to claim 6, wherein each of the engaging projections has a tapered surface and each of the engaging recessed portions has a tapered surface.

9. A vehicle door lock apparatus comprising:

a lever mechanism for locking and unlocking a vehicle door in response to operation of a key cylinder provided at an outside of the vehicle door;

the lever mechanism being directly connected with the key cylinder;

the lever mechanism comprising both an output shaft and an input shaft, the input shaft being directly connected with the key cylinder, the output shaft rotating together with the input shaft to transmit rotation of the input shaft to the output shaft, and the input shaft being inclinable relative to the output shaft; and wherein the input shaft of the lever mechanism includes a key rotor directly connected with the key cylinder, and the output shaft of the lever mechanism includes a key lever directly connected with the key rotor, an inclination of the input shaft relative to the output shaft of the lever mechanism being absorbed through a connection between the key rotor and the key lever.

10. A vehicle door lock apparatus according to claim 9, wherein a rotation axis of the key cylinder is inclinable relative to a rotation axis of the key rotor.

11. The vehicle door lock apparatus according to claim 9, wherein the key rotor is formed with a key rotor-side engaging device, and the key lever is formed with a key lever-side engaging device into which the key rotor-side engaging device is movably inserted, with the inclination of the input shaft relative to the output shaft of the lever mechanism being absorbed through play between the key rotor-side engaging device and the key lever-side engaging device.

12. The vehicle door lock apparatus according to claim 11, wherein the key rotor and the key lever are each provided with a locating device for locating a rotation fulcrum of the key rotor.

13. The vehicle door lock apparatus according to claim 12, wherein a rotation axis of the key cylinder is inclinable relative to a rotation axis of the key rotor.

14. A vehicle door lock apparatus comprising:

a door lock actuator integrally accommodating a link mechanism connected with an outside door handle for opening the vehicle door;

a lever mechanism for locking and unlocking the vehicle door by conducting a changeover of engagement and disengagement of the link mechanism in response to rotation operation of a key cylinder;

a drive mechanism for locking and unlocking the vehicle door by conducting the changeover of engagement and disengagement of the link mechanism by electric drive;

the lever mechanism having an input shaft directly connected with the key cylinder and being inclinable relative to an output shaft of the lever mechanism for actuating the locking and unlocking of the vehicle door; and the input shaft of the lever mechanism including a key rotor directly connected with the key cylinder, and the output shaft of the lever mechanism including a key lever directly connected with the key rotor.

15. The vehicle door lock apparatus according to claim 14, wherein:

the key rotor is formed with a key rotor-side engaging device, and the key lever is formed with a key lever-side engaging device into which the key rotor-side engaging device is movably inserted.

16. The vehicle door lock apparatus according to claim 14, wherein the key rotor includes a locating hole and the key lever includes a locating projection, the locating projection being fitted into the locating hole to define a rotation fulcrum of the key rotor.

17. The vehicle door lock apparatus according to claim 14, wherein one side of the key rotor is provided with an engaging portion that is adapted to be fittingly engaged with an engaging portion of the key cylinder, and an opposite side of the key rotor is provided with a key rotor-side engaging portion, the key lever being provided with a key lever-side engaging portion, the key rotor-side engaging portion and the key lever-side engaging portion being interfitted with one another so that rotation of the key rotor is transferred to the key lever.

18. The vehicle door lock apparatus according to claim 17, wherein the key rotor-side engaging portion of the key rotor includes a plurality of engaging projections arranged in a cross-shaped pattern, the key lever-side engaging portion of the key lever including a plurality of engaging recessed portions arranged in a cross-shaped pattern, the engaging projections being fitted into the engaging recessed portions.

* * * * *